United States Patent [19]

Stone

[11] 4,246,720

[45] Jan. 27, 1981

[54] ATTACHMENT FOR FLYING DISK TOY

[76] Inventor: Myron Stone, 307 Prospect Ave., Hackensack, N.J. 07601

[21] Appl. No.: 94,969

[22] Filed: Nov. 16, 1979

[51] Int. Cl.[3] ..... A63H 27/00

[52] U.S. Cl. ..... 46/74 D; 273/424

[58] Field of Search ..... 46/74 D, 75, 74 R, 82, 46/53, 47; 273/424, 425, 426, 423, 428

[56] References Cited

U.S. PATENT DOCUMENTS

| | | | |
|---|---|---|---|
| D. 155,437 | 10/1949 | Molin et al. | 46/53 UX |
| 2,304,215 | 12/1942 | Streubel | 46/74 R |
| 2,667,352 | 1/1954 | Sepersky | 46/75 X |
| 2,679,711 | 6/1954 | Learnard | 46/53 |
| 2,816,764 | 12/1957 | Gleason | 46/74 R X |
| 4,184,284 | 1/1980 | Rogahn | 46/74 D X |

*Primary Examiner*—Gene Mancene
*Assistant Examiner*—Mickey Yu
*Attorney, Agent, or Firm*—Samuelson & Jacob

[57] ABSTRACT

An attachment for a flying disk toy has a plurality of cantilevered radial vanes for extending over the upper surface of the disk toy and flexing toward and away from the upper surface in fluttering movements during flight to produce a distinctive sound, an aesthetically appealing appearance and an undulating flight path.

13 Claims, 7 Drawing Figures

ATTACHMENT FOR FLYING DISK TOY

The present invention relates generally to flying disk toys and pertains, more specifically, to an attachment for flying disk toys which, during flight, provides a flying disk toy with a distinctive sound, an eye-catching appearance and an undulating flight path.

Flying disk toys have gained a place as a staple item in the field of recreational devices. Among the most popular of these toys is the ubiquitous Frisbee flying disk which has been developed into a high-performance recreational implement. These flying disks usually have a saucer-like configuration and spin about a central axis as they fly along an arched trajectory.

It is an object of the present invention to provide an attachment which can be affixed to a flying disk toy to provide the toy with a distinctive sound during flight.

Another object of the invention is to provide an attachment for a flying disk toy, the attachment providing an aesthetically appealing, eye-catching appearance during flight of the implement.

Still another object of the invention is to provide an attachment of the type described and which alters the normal flight trajectory of a flying disk toy so that the toy will follow an undulating flight path.

Yet another object of the invention is to enhance the overall appeal of flying disk toys.

A further object of the invention is to provide an attachment of the type described and which is exceptionally simple in construction and adds to the performance of a flying disk toy.

A still further object of the invention is to provide an attachment of the type described and which is easy to use.

Yet a further object of the invention is to provide an attachment of the type described and which is economically fabricated in large numbers of uniform high quality.

The above objects, as well as still further objects and advantages, are attained by the present invention which may be described briefly as an attachment for a flying disk toy, the flying disk toy having an upper surface with a generally central area and an outer rim, the attachment comprising: a central portion capable of being affixed over the central area of the flying disk toy; a plurality of cantilevered vanes having free tips and projecting radially from the central portion of the free tips for extending over the upper surface of the flying disk toy between the central area and the outer rim thereof; and means for enabling flexing of the vanes relative to the central portion of the attachment so as to allow the vanes to flutter in response to rotation and translation of the flying disk toy during flight.

The invention will be understood more fully, while still further objects and advantages will become apparent, in the following detailed description of embodiments thereof illustrated in the accompanying drawing, in which.

Figure 1:
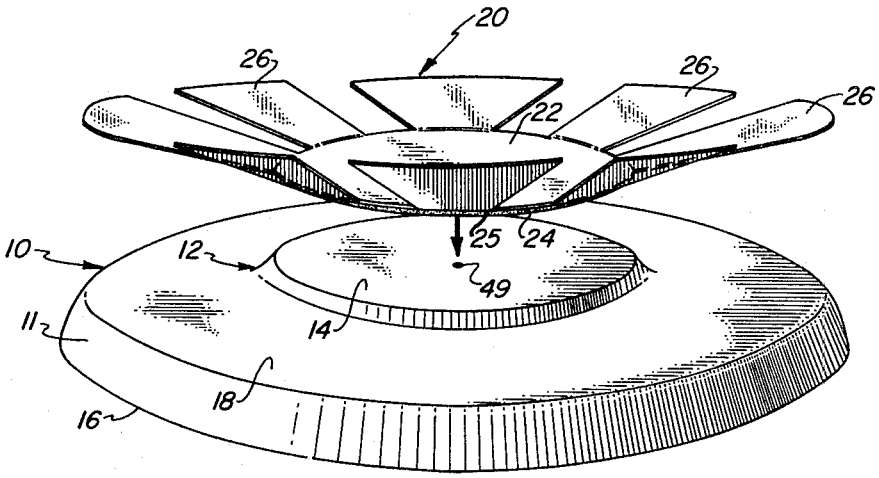
FIG. 1 is a perspective view illustrating an attachment constructed in accordance with the invention, with the attachment about to be affixed to a flying disk toy.

Referring now to the drawing, and especially to FIG. 1 thereof, a typical flying disk toy 10 is shown in the form of a member 11 having an inverted saucer-like configuration including an upper surface 12 which has a central area 14, a peripheral rim 16 and a curved surface portion 18 extending smoothly between the central area 14 and the rim 16.

An attachment 20, constructed in accordance with the invention, is shown about to be attached to the flying disk toy 10. Attachment 20 has a central portion 22 capable of being affixed to the central area 14 of the flying disk toy 10. In the illustrated embodiment, central portion 22 has an adhesive layer 24 on a contact surface 25 located on the underside of central portion 22, which adhesive layer 24 will affix the contact surface 25 of central portion 22 to the central area 14 of upper surface 12.

Figure 2:
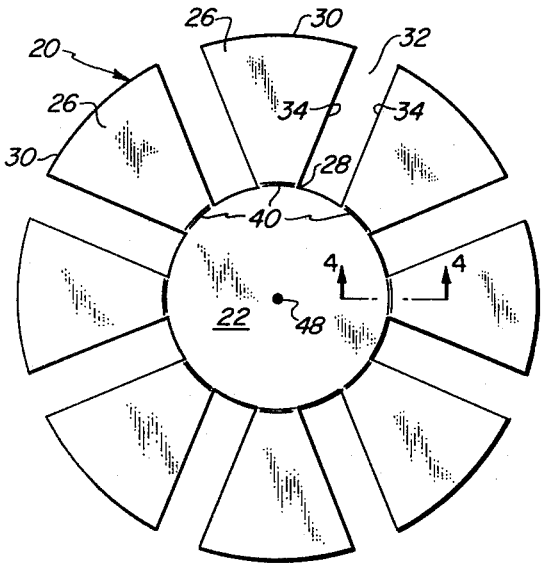
FIG. 2 is a top plan view of the attachment.
Figure 3:
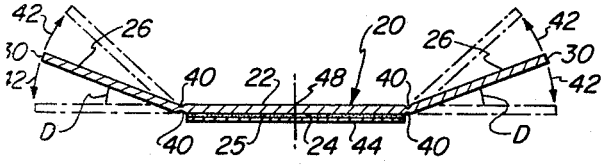
FIG. 3 is a diametrical cross-sectional view of the attachment.

Turning now to FIGS. 2 and 3, as well as to FIG. 1, attachment 20 includes a plurality of cantilevered vanes 26 extending radially outwardly from central portion 22. Vanes 26 each project radially outwardly from a root 28 to a free tip 30 located at the outer perimeter of the attachment 20. The vanes 26 are spaced apart circumferentially by relatively narrow spaces 32 between the vanes 26. Preferably, the confronting side edges 34 of adjacent vanes 26 are parallel to one another, thereby providing each vane 26 with a wedge-shaped plan configuration, tapering outwardly from a smaller area at the root 28 to a larger area at the tip 30.

Figure 4:
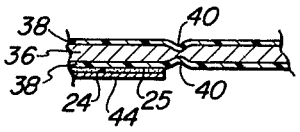
FIG. 4 is an enlarged fragmentary cross-sectional view taken along line 4—4 of FIG. 2.

Attachment 20 is fabricated from a relatively thin, flexible material of generally uniform thickness. As best seen in FIG. 4, a preferred construction is a composite material having a paper core 36 of approximately seventy pound weight paper with a layer 38 of silvered Mylar polyester film laminated to each face of the core 36. Layer 38 is approximately one-half mil in thickness. Such a construction not only is light in weight, but is water-resistant and tear resistant for added service life. Score lines 40 placed at the roots 28 of the vanes 26 provide a portion of reduced thickness to enhance the ability of the vanes 26 to move upwardly and downwardly relative to the central portion 22, as illustrated by arrows 42 in FIG. 3, for purposes which will be described below. Attachment 20 is easily manufactured by die cutting the overall shape. The vanes 26 are given a slight amount of dihedral, as illustrated by the angle D in FIG. 3, by bending the vanes 26 upwardly relative to central portion 22 about score lines 40.

Ordinarily, attachment 20 is sold as a separate unit for attachment to any selected, commercially available flying disk toy. Thus, means are provided for securing the attachment to the flying disk toy. In the illustrated embodiment, attachment 20 is affixed to flying disk toy 10 by means of adhesive layer 24 which, preferably, is a pressure-sensitive adhesive. The adhesive layer 24 is covered with a protective release sheet 44 which subsequently is peeled away to expose the adhesive layer 24 for attachment to the flying disk toy. Of course, attachment 20 and flying disk toy 10 may be sold as a unit, with the attachment 20 already integral with the flying disk toy 10.

Once the attachment 20 is affixed to the central area 14 of the upper surface 12 of member 11 of the flying disk toy 10, with vanes 26 projecting radially outwardly, at the appropriate dihedral angle D, over the curved surface portion 18 of the upper surface 12, the flying disk toy 10 is ready for flight. It is noted that the overall diameter of the attachment is approximately the same as the overall diameter of the flying disk toy 10 so that the vanes 26 extend radially essentially over the entire distance between the central area 14 and the rim 16 of the flying disk toy 10.

Figure 5:
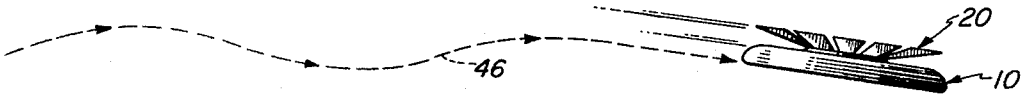
FIG. 5 is a pictorial illustration of the flying disk toy in flight with the attachment.

When the flying disk toy 10 is in flight, with attachment 20 in place, vanes 26 will flutter, as a result of upward and downward movement of the vanes 26 relative to the upper surface 12 of the flying disk toy 10 induced in response to rotation and translation of the flying disk toy 10 along its trajectory. Such fluttering movement is enabled by the flexibility of the material of construction of the attachment 20, and is enhanced by the reduced thickness provided at score lines 40 and by the tapered, wedge shape of the vanes. The fluttering movement of the vanes 26 provides several desirable effects. First, a quite distinctive fluttering sound is generated, which sound adds interest to the flight of the toy. Second, the fluttering movement of the silvered vanes 26 produces eye-catching reflections which are aesthetically pleasing. Third, the flutter of the vanes 26 induces the flying disk toy 10 to follow an undulating flight path, as illustrated at 46, in FIG. 5, which is a departure from the normal arched trajectory of an ordinary flying disk toy. In order to maintain the proper balance for flight, the vanes 26 are arranged symmetrically about the centerpoint 48 of the attachment 20 and centerpoint 48 is located coincident with the centerpoint 49 of the member 11.

Figure 6:
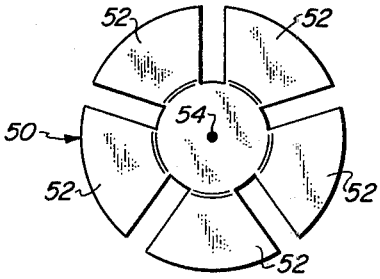
FIG. 6 is a reduced top plan view of an alternate configuration for an attachment constructed in accordance with the invention.

Referring now to FIG. 6, another attachment constructed in accordance with the invention is shown at 50. Attachment 50 is constructed similar to attachment 20, except that the number of vanes 52 is five instead of the eight vanes 26 of attachment 20. Even though there is an odd number of vanes 52, the vanes 52 are arranged symmetrically about centerpoint 54 of attachment 50. Thus, balance is maintained as the attachment 50 rotates about its central axis.

Figure 7:
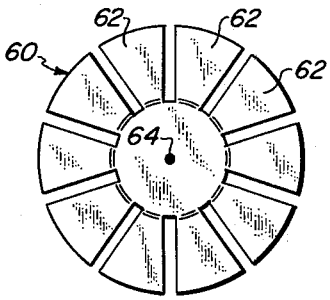
FIG. 7 is a reduced top plan view of another alternate configuration.

Turning now to FIG. 7, still another attachment constructed in accordance with the invention is shown at 60. Attachment 60 has a construction similar to attachment 20, but includes ten vanes 62. Here again, the vanes 62 are arranged symmetrically about centerpoint 64 of attachment 60.

Thus, the present invention provides a relatively inexpensive adjunct to the popular flying disk toy, adding a novel sound and appearance, and further interest in an already accepted recreational implement.

It is to be understood that the above detailed description of embodiments of the invention are provided by way of example only. Various details of design and construction may be modified without departing from the true spirit and scope of the invention as set forth in the appended claims.

The embodiments of the invention in which an exclusive property or previlege is claimed are defined as follows:

1. An attachment for a flying disk toy, the flying disk toy including a member having an upper surface with a generally central area and an outer rim, said attachment comprising:

a central portion capable of being affixed over the central area of the flying disk toy;

a plurality of cantilevered vanes having free tips and projecting radially from the central portion to the free tips for extending over the upper surface of the flying disk toy between the central area and the outer rim thereof; and means for enabling flexing of the vanes relative to the central portion of the attachment so as to allow the vanes to flutter and generate a distinctive fluttering sound in response to rotation and translation of the flying disk toy during flight.

2. The invention of claim 1 wherein the central portion has a contact surface for contacting the central area of the flying disk toy.

3. The invention of claim 2 wherein the central portion includes securing means for affixing the contact surface to the central area of the flying disk toy.

4. The invention of claim 3 wherein the securing means includes an adhesive on the contact surface.

5. The invention of claim 1, 2, 3 or 4 wherein the attachment has a centerpoint and the vanes are arranged symmetrically about the centerpoint.

6. The invention of claim 5 wherein the central portion and the vanes comprise a unitary structure of relatively thin, flexible material, such as paper.

7. The invention of claim 6 wherein the vanes have a generally uniform thickness and the means for enabling flexing of the vanes relative to the central portion includes a portion of reduced thickness.

8. The invention of claim 5 wherein the vanes extend radially at a dihedral angle relative to the central portion.

9. A flying disk toy comprising:

a member having a saucer-like configuration including an upper surface with a central area and an outer rim;

a plurality of cantilevered vanes having free tips and projecting radially from the central area to the free tips, the vanes extending over and being spaced upwardly from the upper surface of the saucer-like member between the central area and the rim thereof; and means for enabling flexing of the vanes relative to the member so as to enable the vanes to flutter and generate a distinctive fluttering sound in response to rotation and translation of the flying disk toy during flight.

10. The invention of claim 9 wherein the member has a centerpoint and the vanes are arranged symmetrically about the centerpoint.

11. The invention of claim 9 or 10 wherein the vanes have a generally uniform thickness and the means for enabling flexing of the vanes relative to the central area includes a portion of reduced thickness.

12. The invention of claim 11 wherein the vanes extend radially at a dihedral angle relative to the central area.

13. The invention of claim 11 wherein the vanes extend to an overall diameter at the free tips, which overall diameter is approximately the same as the overall diameter of the member at the rim thereof.

* * * * *